US008141502B2

(12) United States Patent
Eteläaho et al.

(10) Patent No.: US 8,141,502 B2
(45) Date of Patent: Mar. 27, 2012

(54) FLUIDIZED BED BOILER AND A GRATE ELEMENT FOR THE SAME

(75) Inventors: Risto Eteläaho, Tampere (FI); Vesa Kainu, Kangasala (FI)

(73) Assignee: Metso Power Oy, Tampere (FI)

( * ) Notice: Subject to any disclaimer, the term of this patent is extended or adjusted under 35 U.S.C. 154(b) by 426 days.

(21) Appl. No.: 11/785,668

(22) Filed: Apr. 19, 2007

(65) Prior Publication Data

US 2007/0245935 A1 Oct. 25, 2007

(30) Foreign Application Priority Data

Apr. 20, 2006 (FI) ..... 20065245

(51) Int. Cl.
*F23G 5/00* (2006.01)
*F23C 10/00* (2006.01)
*F28D 13/00* (2006.01)

(52) U.S. Cl. ..... 110/245; 122/4 D; 165/104.16; 165/172

(58) Field of Classification Search ..... 110/229, 110/245, 243, 244; 165/151, 152, 153, 172, 165/173, 174, 175, 176, 104.16; 122/4 D, 122/510

See application file for complete search history.

(56) References Cited

U.S. PATENT DOCUMENTS

| | | | | |
|---|---|---|---|---|
| 4,270,599 | A * | 6/1981 | Connell | 165/104.16 |
| 4,619,315 | A | 10/1986 | Waryasz | |
| 5,743,197 | A | 4/1998 | Kinni et al. | |
| 5,966,839 | A * | 10/1999 | Pohja et al. | 34/578 |
| 6,782,848 | B2 | 8/2004 | Kinni | |

FOREIGN PATENT DOCUMENTS

| | | | |
|---|---|---|---|
| DE | 3347083 | A1 | 7/1985 |
| DE | 3431343 | A1 | 3/1986 |
| DE | 3828646 | A1 | 3/1990 |
| EP | 0295324 | A1 | 12/1988 |
| EP | 0349765 | A1 | 1/1990 |

* cited by examiner

*Primary Examiner* — Kenneth Rinehart
*Assistant Examiner* — David J Laux
(74) *Attorney, Agent, or Firm* — Venable LLP; Eric J. Franklin

(57) ABSTRACT

A fluidized bed boiler comprises a furnace whose lower part is equipped with a grate comprising means for supplying fluidizing air into the furnace. The furnace also comprises at least one heat transfer surface extending across the furnace and comprising elongated heat transfer tubes on top of each other. The heat transfer surface is supported on the grate from underneath, substantially over its whole length, in the section extending across the furnace.

18 Claims, 4 Drawing Sheets

A–A

FLUIDIZED BED BOILER AND A GRATE ELEMENT FOR THE SAME

FIELD OF THE INVENTION

The invention relates to a fluidized bed boiler comprising a furnace whose lower part is provided with a grate comprising means for supplying fluidizing air into the furnace, wherein the furnace comprises at least one heat transfer surface extending through the furnace and comprising elongated heat transfer pipes on top of each other.

BACKGROUND OF THE INVENTION

In the furnace of the fluidized bed boiler, the combustion takes place in a so-called fluidized bed consisting of solid particulate bed material which is kept in a fluidized state by means of fluidizing air supplied from underneath. At the same time, fuel is supplied continuously into the furnace to maintain the combustion process. The thermal energy produced by the combustion is transferred primarily to heat transfer surfaces of the walls of the furnace, to heat transfer medium flowing in their tubes, and furthermore, energy is also recovered from flue gases exiting from the furnace.

Underneath, the furnace is limited in the horizontal plane by the grate which comprises elongated elements next to each other, fluidizing air being supplied through the elements into the furnace. The elements may be, for example, so-called box beams. Fluidizing air is supplied into the box beams and distributed into nozzles in the beams, for supplying the fluidizing air evenly over the grate area. Through openings left between the elements, material can be removed from the bed into a discharge unit underneath the grate. Examples of grate structures for a fluidized bed boiler are presented, among others, in U.S. Pat. Nos. 5,743,197 and 5,966,839.

Various types of fuels can be used in fluidized bed combustion. The combustion conditions in the fluidized bed boiler may vary, depending on the fuel. If, for example, the fuel has a high adiabatic combustion temperature, the heat transfer surfaces of the walls of the furnace are not sufficient to keep the temperature of the bed in a suitable range. One approach is to use circulation gas for cooling, but this will reduce the efficiency of the boiler. On the other hand, the bed temperature cannot be allowed to rise too high, because it will easily cause sintering of the bed material.

A known method for cooling the bed to a suitable combustion temperature is to equip the furnace with heat transfer tubes extending through it in the horizontal direction, for example between opposite walls. The tubes can be installed on top of each other to form bundles which can be supported to each other by means of connecting tubes extending crosswise between the bundles. Such heat transfer surfaces "immersed" in the fluidized bed are disclosed e.g. in the German published patent application 3347083. The heat transfer surfaces disclosed in said publication consist of bundles of quadrangular tubes stacked on top of each other, bundles of round tubes stacked on top of each other and equipped with a protective layer, or groups of separate pipes equipped with vertical protective wings. In said publication, the aim is to arrange the side walls of the heat transfer surfaces as vertical as possible so that the bubbling of the fluidized bed and the vertical motion of its material would cause as little erosion as possible in the heat transfer surfaces. Other approaches to protect the heat transfer surfaces from the erosive effects of the fluidized bed and from corrosion are disclosed, for example, in German published patent applications 3431343 and 3828646 as well as in European patent 349765.

Now, the bubbling of the fluidized bed and the movements of the material therein, caused by the fluidizing air, subject any heat transfer surfaces extending across the furnace to erosion. Therefore, in said patents, attempts have been made to minimize the loading of the heat transfer surfaces by arranging the side walls of the heat transfer surfaces as vertical as possible, i.e., parallel to the primary direction of movement of the bed material. In these arrangements, the heat transfer surface structures extend in the horizontal direction across the bed in the inner volume of the furnace. However, the problem is that particularly the lower part of said structures is subjected to the erosive effect of the fluidizing air and the fluidized bed material, and furthermore, the movements of the bed cause vibrations which may reduce the strength of the structures, for example the protective layer of the pipes. In European patent 349765, heat transfer pipes placed on top of each other are protected on both sides by vertical shields, a kind of a housing arrangement, in which a horizontal gap is left at the upper and lower edges of the housing. The gap at the lower edge throttles the flow of air to such an extent that it cannot fluidize the fluidized bed material in the space between the protective shields. However, the lower parts of the protective shields on both sides of the gap remain exposed to the effects of the fluidizing air and the bed material, and furthermore, said structure is subjected to clogging.

SUMMARY OF THE INVENTION

The aim of the invention is to eliminate said drawbacks and to present a fluidized bed boiler, in which it is possible to cool the furnace by heat transfer surfaces extending through it and, at the same time, to recover heat, but to avoid the problems of erosion and wear relating to such heat transfer surfaces. Another aim of the invention is to present a novel grate element for implementing a fluidized bed boiler of this type.

For achieving the aim, the fluidized bed boiler is primarily characterized in that the heat transfer surface is supported from underneath, substantially over its whole length, on the grate.

As the grate consists of elongated elements next to each other, the heat transfer surface can be placed on top of such an elongated element, in parallel with it, and supported from underneath, substantially over its whole length, on this element.

The structure is simple and can be used to avoid the problems of erosion and wear in the lower part of the heat transfer surface. A bundle consisting of heat transfer tubes on top of each other, possibly equipped with a protective layer, can be simply mounted in the vertical position on top of an elongated element, for example a box beam, in such a way that the heat transfer tubes extend in parallel with the element. As the tubes are supported over their whole length on the grate element, vibrations are also eliminated which have been problematic in tube bundles or groups extending freely across the inner volume of the furnace. The structure is strong but at the same time it ensures efficient heat transfer, if there is a need to cool the bed so as not to exceed a given maximum temperature.

Such heat transfer surfaces can be placed in several parallel elements of the grate. They can be provided at regular intervals in certain elements or, say, in every element.

The side surfaces of the heat transfer surfaces can be arranged vertically by methods known as such, for example with a protective layer for the heat transfer tubes. The material used in the protective layer may be a protective mass with a high heat transfer coefficient. The heat transfer tubes may also be equipped with pins to improve the adhesion between the tubes and the protective layer and to increase the heat transfer.

The same heat transfer surface comprises at least three tubes, preferably four or more. A suitable number of tubes is 4 to 10.

The grate element according to the invention comprises an elongated air beam equipped with fluidizing nozzles and a heat transfer surface placed on top of it, comprising heat transfer tubes on top of each other, all integrated to a single elongated prefabricated profile to be installed in the grate.

As for the other characteristic features and advantages of the invention, reference is made to the following description and the appended claims.

BRIEF DESCRIPTION OF THE DRAWINGS

In the following, the invention will be described in more detail with reference to the appended drawings, in which.

DETAILED DESCRIPTION OF THE PREFERRED EMBODIMENTS

Figure 1:
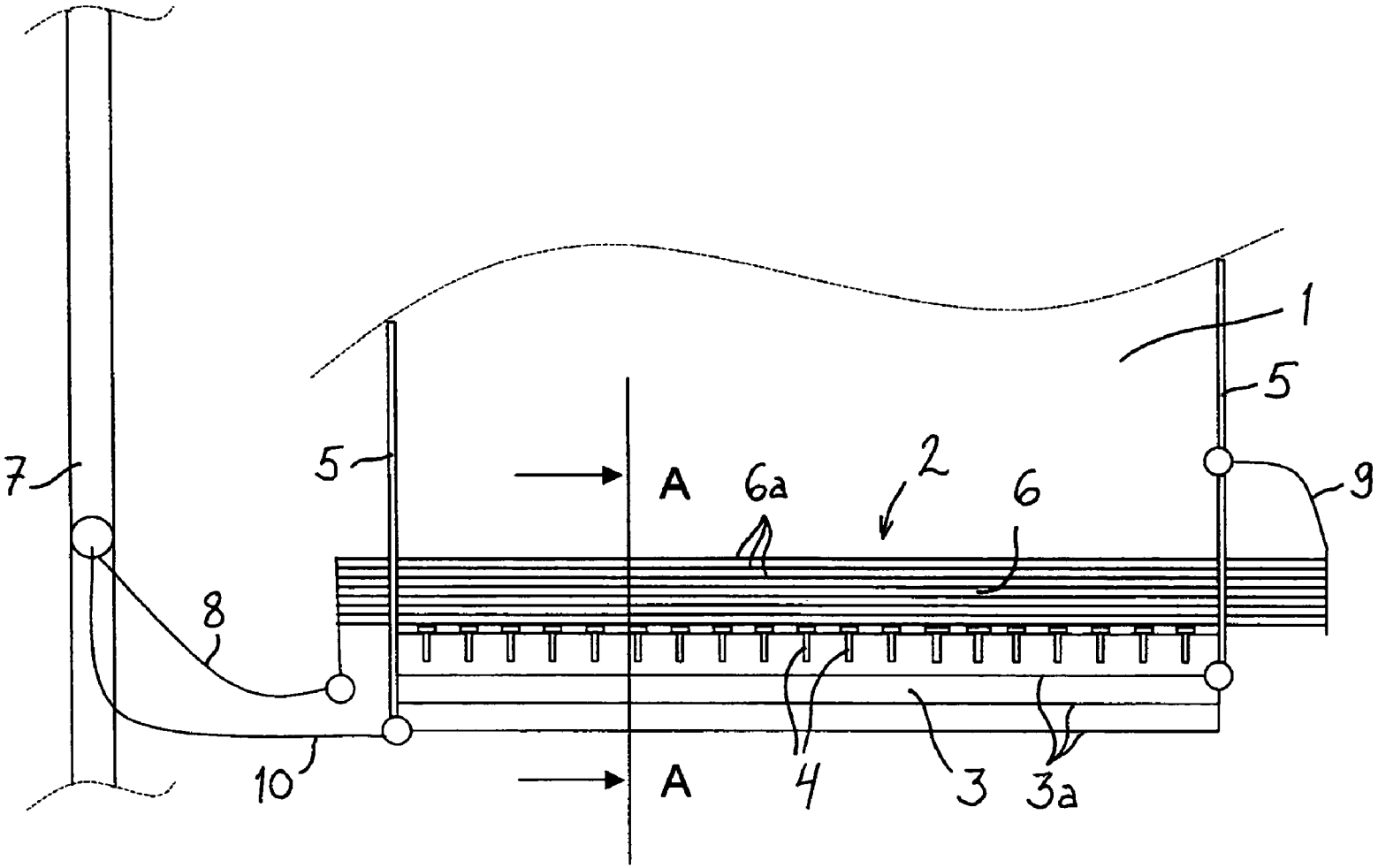
FIG. 1 shows the lower part of the furnace in a cross-sectional view.
Figure 6:
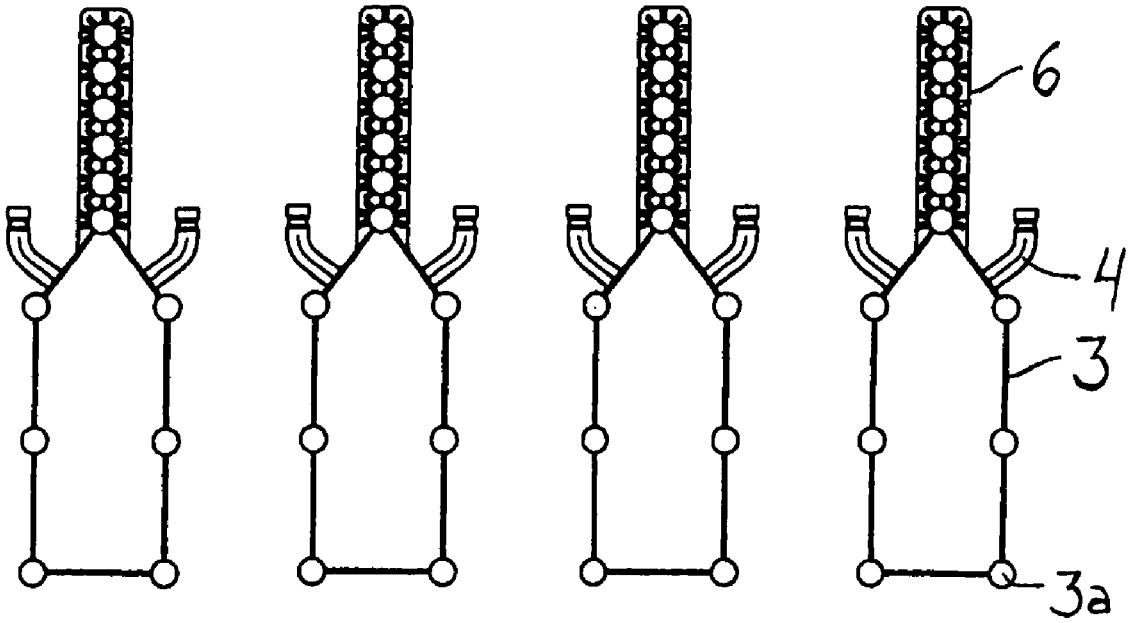
FIG. 6 shows the grate in cross-section along plane A-A of FIG. 1.

FIG. 1 is a cross-sectional view showing the lower part of the furnace 1 of a fluidized bed boiler, limited from underneath by a horizontal grate 2. The grate consists of parallel longitudinal hollow elements 3 with means 4 for supplying fluidizing air upwards into the furnace. FIG. 1 shows, in a side view, a single grate element 3 provided at certain intervals in the longitudinal direction with air nozzles used as means 4 for supplying fluidizing air. The elements with the air nozzles are arranged at certain intervals in the transverse direction so that they form a grate with openings left between the elements 3 as shown in FIG. 6. Coarse material can be discharged from the bed through the openings into a discharge unit underneath the grate.

From the sides, the furnace is limited by vertical walls 5 with heat transfer tubes for transferring energy, released during the combustion, into a heat transfer medium flowing in the tubes. The heat transfer medium is water which evaporates in the tubes. The water circulations of the evaporator circuit of the fluidized bed boiler and the other heat transfer surfaces for recovering energy may be known as such, and they will not be discussed in more detail, as they are not involved in the invention. The supply of fuel and secondary air into the furnace may be implemented by conventional arrangements and they will not be described in more detail.

FIG. 1 also shows an additional heat transfer surface 6 in the lower part of the furnace, extending between opposite walls 5 through the lower part of the furnace 1 in the horizontal direction. The function of the heat transfer surface 6 is to cool the bed in case the fuel is of such a quality that the recommended maximum combustion temperature is exceeded. This additional heat transfer surface consists of an array of heat transfer tubes 6*a* placed on top of each other and mounted directly on top of the element 3, in parallel with the same. Thus, the element 3 supports the tubes 6*a* along their whole length from underneath. The lower edge of the bundle constituted of tubes is thus integrated as a part of the element 3, and it is not exposed inside the furnace, subject to the erosive effect of the fluidizing air and the fluidized bed material nor to various vibrations. The tubes 6*a* are made of steel, and they are covered with a mass or a coating to protect them. The structures protecting the tubes from the conditions of the fluidized bed will be described in more detail hereinbelow.

FIG. 1 shows, in a side view, only one heat transfer surface 6 placed on top of a corresponding element 3. However, there may be several similar heat transfer surfaces 6 placed on adjacent elements 3 of the grate. It is possible to provide each element 3 of the grate with a heat transfer surface composed of tubes 6*a*, or to place heat transfer surfaces 6 more sparsely so that they are fewer in number than the elongated elements 3. In particular, it is advantageous to leave at least the outermost elongated elements 3 without a heat transfer surface, because these elements are close to a parallel side wall whose heat transfer surface cools the bed in the marginal area sufficiently. At the same time, the development of narrow points close to the side of the furnace is avoided. There may also be heat transfer surfaces 6 in the central area of the grate 2, distributed so that only a part of the elements 3, for example every second element 3, is equipped with a heat transfer surface.

FIG. 1 also shows the connection of the heat transfer surface to the circulation of medium in the boiler. A heat transfer medium, to which the heat of the furnace 1 is transferred, flows through the tubes 6*a* of the heat transfer surface. The tubes 6*a* are connected to the rest of the tube system of the boiler, wherein the same heat transfer medium flows therein. Thus, the flow of the medium inside the tubes 6*a* of the heat transfer surface 6 occurs spontaneously as part of the medium circulation in the boiler, and separate circulating pumps will not be needed. FIG. 1 shows a downcomer pipe 7 from a drum in the upper part of the boiler, inlet tubes 8 being branched off the downcomer pipe 7 for supplying water into the tubes 6*a* of the heat transfer surfaces 6 (only one inlet tube 8 and one heat transfer surface 6 are shown in the figure). The opposite ends of the tubes 6*a* of the heat transfer surface 6 are connected to the tubes of the wall 5 of the furnace by means of a connecting tube 9. Thus, the cooling of the heat transfer surface 6 is implemented as a part of the evaporator circuit operating by the principle of natural circulation in the boiler, and evaporation takes place in the tubes 6*a* of the heat transfer surface. The ends of the heat transfer surface 6 are led through the walls 5 of the furnace 1 in a gas-tight manner, and its connections to the medium circulation (evaporator circuit) of the boiler are outside the furnace 1. Further, in the area outside the furnace, there is no need to support and shield the heat transfer surface 6 from underneath.

By a suitable tubing, the flow of the heat transfer medium can also be provided so that the flows are in opposite directions in different heat transfer surfaces 6.

The figure also shows cooling channels 3*a* for cooling the elongated grate element 3 arranged, for example, by the principle disclosed in U.S. Pat. No. 5,743,197. The entire disclosure of the U.S. Pat. No. 5,743,197 is incorporated herein by reference. Also these cooling channels 3*a* are a part of the evaporator circuit operating by the principle of natural circulation in the boiler, and their supply water can also be taken from the downcomer pipe 7. FIG. 1 shows an inlet tube 10 for the cooling tubes 3*a* of the element, connected to the downcomer pipe 7. At the opposite end, the cooling tubes 3*a* are connected to the heat transfer tubes of the wall 5.

Figure 2:
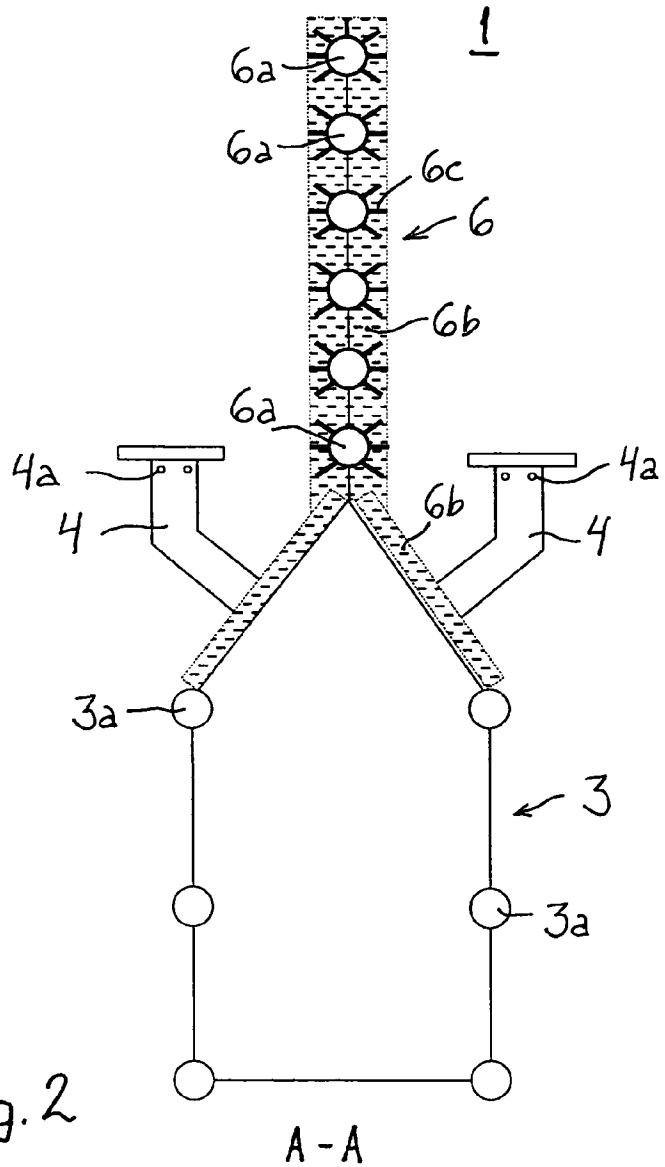
FIG. 2 shows a cross-section of the grate at one element in plane A-A of FIG. 1, FIGS. 3 to 5 show different types of elements in cross-sectional views.

FIG. 2 shows, in a cross-sectional view, a grate element 3 integrated to a single structural element, and a heat transfer surface 6. The elongated grate element 3 is a so-called box beam, inside which fluidizing air flows. The element 3 is used, in a way, as a supporting beam for the heat transfer surface 6. As shown in the figure, the heat transfer surface 6 has, in a cross-sectional view perpendicular to the longitudinal direction of the element 3, the general shape of an upright rectangle, whose long flanks are substantially parallel and vertical. The element 3 and the heat transfer surface 4 jointly form a profile which has substantially the same shape over its whole length, the lower part consisting of the element 3 and the upper part consisting of the narrower heat transfer surface 6. The heat transfer surface is mounted on the upper wall of the element 3, which in FIG. 2 is a structure having the shape of a saddle roof with the shape of an inverted V. The lowermost pipe 6*a* of the heat transfer surface is mounted to the ridge of the upper wall by means of a vertical web plate.

FIG. 2 also shows nozzles used as means 4 for supplying fluidizing air, which are connected to the hollow inside of the element 3, into which the fluidizing air is fed. In the cross direction, the nozzles 4 are placed at a sufficient distance from the heat transfer surface 6. The nozzle pipes of the nozzles are arranged to be oriented to the sides so that the nozzle openings 4*a* at their top end are distributed as evenly as possible in the area of the grate 2, to secure even distribution of the fluidizing air. This principle is disclosed in U.S. Pat. No. 5,966,839. The entire disclosure of the U.S. Pat. No. 5,966,839 is incorporated herein by reference Furthermore, it is advantageous to place the nozzle openings for the fluidizing air at a suitable distance from the heat transfer surface 6 in the lateral direction.

Furthermore, the figure also shows a protective layer 6*b* forming the outer surface of the heat transfer surface and placed around the heat transfer tubes 6*a* to shield them. The protective layer may be made of, for example, a known protective mass used in boilers. The protective mass used may be, for example, a silicon carbide mass with a high coefficient of thermal conductivity. The heat transfer tubes 6*a* are pinned (pins 6*c*) to improve the heat transfer and to increase the adhesion between the mass and the tubes. As shown in the figure, the protective layer 6*b* may also extend over the upper wall of the element 3 wider than the width of the heat transfer surface 6, which feature reinforces the structure and simultaneously protects the upper part of the box beam.

In view of the heat transfer, it is also advantageous that the lowermost tube 6*a* of the heat transfer surface is above the nozzle plane determined by the nozzle openings 4*a* of the nozzles 4, above which plane also the fluidized bed material is moving.

Figure 3:
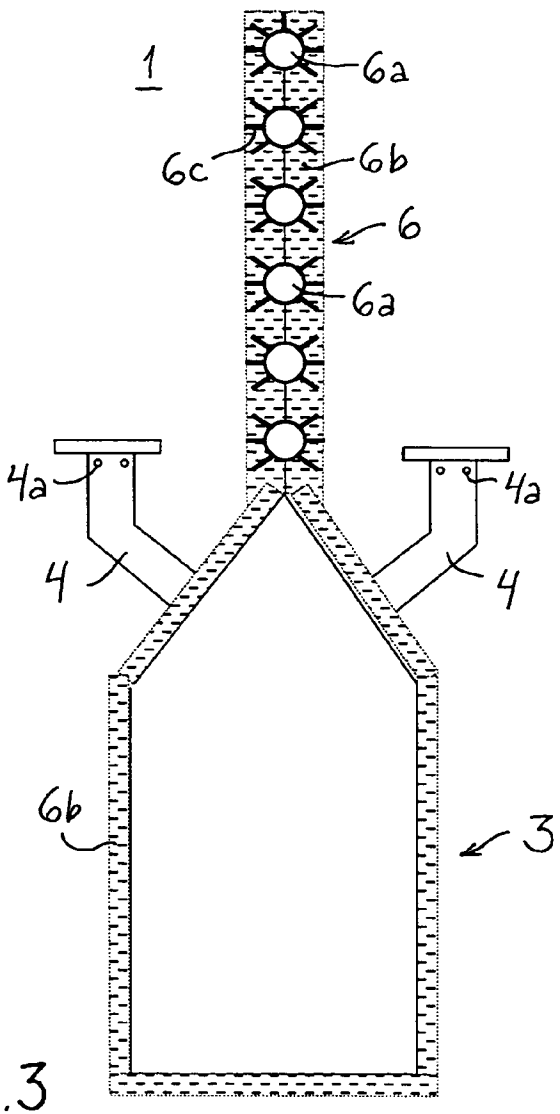
Figure 5:
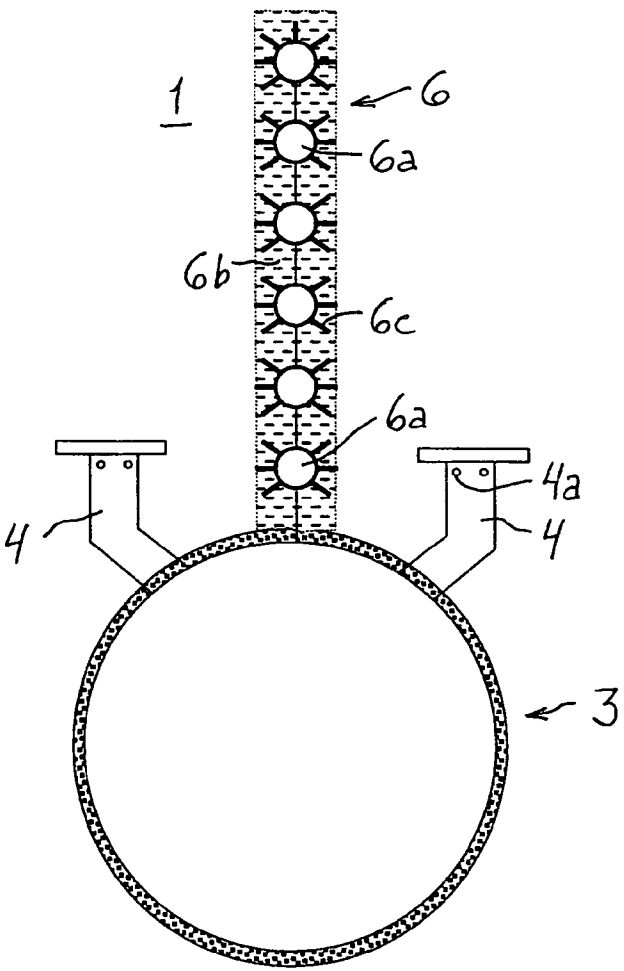
Figure 4:
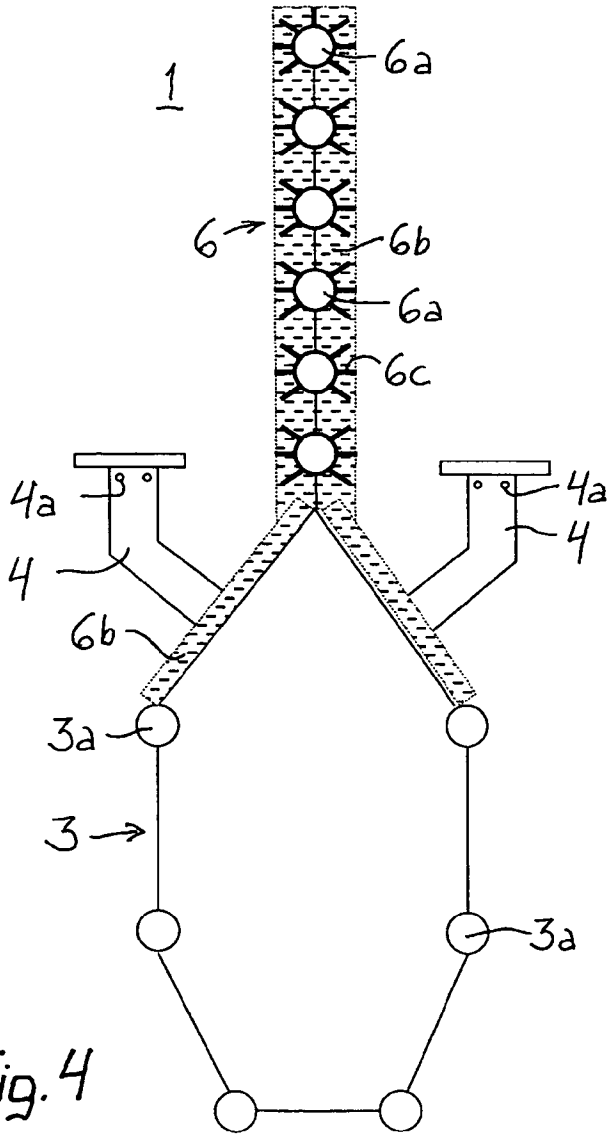

FIGS. 3 to 5 show other structural arrangements which differ from the profile of FIG. 3 primarily with respect to the structure of the element 3 (box beam). In FIG. 3, the element 3 is similar to that in FIG. 2 in its general cross-sectional shape, but there are no cooling channels 3*c* in its corners and walls. In this uncooled beam, the protective layer 6*b* extends around the whole beam. The profile of FIG. 4 is characterized in the downwards tapering of the rectangular lower part of the element 3, and the cooling channels 3*c* are included. The protective layer 6*b* also covers the upper wall of the element 3 in the same way as in FIG. 2. The element 3 of FIG. 5, in turn, has a circular cross-sectional shape and is an uncooled beam (without cooling channels 3*a*), and it is protected with a mass consisting of a different material than the protective layer of the heat transfer surface 6. Also in this case, the lowermost tube 6*a* is connected to the element 3 by means of a plate.

In practice, the heat transfer surface can be manufactured and installed in such a way that the pinned tubes 6*a* are welded together to form a "tube bundle", in which the tubes are horizontal and on top of each other, and this bundle is attached to the element 3, for example, by welding. In FIGS. 2 to 5, the tubes 6*a* of the tube bundle are connected to each other with plates. After the tubes have been connected to each other and installed on top of the element 3, a protective layer can be formed around the tube bundle, for example, with the above-described mass. The heat transfer surfaces 6 can be formed in both existing fluidized bed boilers, in connection with their maintenance operations, in which case they are mounted on top of existing elements of the grate, for example on top of box beams, or it can be made ready in new boilers. Thus, for example the box beam and the heat transfer surface as well as the nozzles connected to the box beam can be made as a prefabricated element for assembling the grate of the fluidized bed boiler from a plurality of such elements.

The number of heat transfer tubes in the heat transfer surface 6 may vary. It is advantageously at least three, preferably 4 to 10.

The invention is well suited to be also used in an adjustable beam grate, in which the width of the fluidized area is adjusted by beam-specific control means, which control the supply of fluidizing air into the single box beams or parts thereof. Such a beam grate is disclosed in U.S. Pat. No. 6,782,848. The entire disclosure of the U.S. Pat. No. 6,782,848 is incorporated herein by reference The invention is not restricted to the structures and profile shapes described above, but it can be modified within the scope of the inventive idea presented in the claims. The material for manufacturing the elements 3 and the tubes 6*a* is a suitable heat-resistant metal, such as steel. The heat transfer tubes 6*a* may also be attached on top of each other and to the underlying element 3 without protection, if only a strong support is to be achieved over the whole length of the tube bundle. Similarly, the protective layer 6*b* may only be provided over the length where protection for the tubes is needed because of the conditions. The cross-sectional shape of the heat transfer surface 6 may also be slightly conical, that is, it is wider in the lower part than in the upper part, and its side walls are not exactly parallel. Furthermore, in the furnace 1, the heat transfer tubes 6*a* do not need to be supported to the element 3 over their whole length but only over the length where this is allowed by the structure of the element 3.

The need for circulating gas used for cooling decreases mathematically by 30 to 100%, when the fluidized bed boiler is equipped with the heat transfer surfaces according to the invention, which increases the efficiency of the electricity production of the boiler.

Moreover, the invention is not limited to any specific type of a fluidized bed boiler. The invention is well suited for bubbling fluidized bed boilers, thanks to their temperature profile, but it can be used in both circulating and bubbling fluidized bed boilers.

What is claimed is:

1. A fluidized bed boiler comprising a circulation of heat transfer medium and a furnace, said furnace comprising:

an inner volume, a lower part comprising a grate comprising a plurality of elongated elements spaced at intervals next to each other, wherein the elongated elements are arranged in a profile having substantially the same shape over a length of the elongated elements in a longitudinal direction of the elongated elements, said elongated elements comprising means for supplying fluidizing air into the furnace and leaving openings in areas between the elements, said openings extending parallel to the elongated elements and being configured to discharge coarse material from the bed through the openings into a discharge unit underneath the grate, and at least one heat transfer surface extending through the inner volume of the furnace;

said heat transfer surface comprising elongated heat transfer tubes on top of each other and being supported from underneath, over its whole length, on the grate in a section extending through the inner volume of the furnace, wherein the heat transfer surface is arranged on top of one of the elongated elements of the grate, in parallel with the longitudinal direction of the one elongated element of the grate, and supported from underneath over its whole length on the one elongated element of the grate, said elongated heat transfer tubes being arranged on top of each other and extending parallel to the longitudinal direction of the one elongated element.

2. The fluidized bed boiler according to claim 1, wherein side walls of the heat transfer surface are perpendicular to the grate and parallel.

3. The fluidized bed boiler according to claim 2, wherein the heat transfer tubes of the heat transfer surface comprise a protective layer having an outer surface forming the side walls of the heat transfer surface.

4. The fluidized bed boiler according to claim 1, wherein the heat transfer tubes of the heat transfer surface are connected to the circulation of the heat transfer medium of the boiler.

5. The fluidized bed boiler according to claim 1, wherein the number of heat transfer tubes placed on top of each other in the heat transfer surface is at least 3.

6. The fluidized bed boiler according to claim 5, wherein the number of heat transfer tubes is 4 to 10.

7. The fluidized bed boiler according to claim 1, wherein a lowermost heat transfer tube of the heat transfer surface is connected by a vertical plate to an upper wall of the elongated element of the grate.

8. The fluidized bed boiler according to claim 1, wherein the elongated elements comprise hollow box beams and the means for supplying fluidizing air comprises nozzles connected to hollow insides of the elements.

9. The fluidized bed boiler according to claim 1, wherein two or more heat transfer surfaces are placed on top of the elongated elements of the grate and supported from underneath over their whole lengths on the elongated elements, said heat transfer surfaces comprising elongated heat transfer tubes arranged on top of each other and extending parallel to the longitudinal direction of the elongated elements.

10. The fluidized bed boiler according to claim 9, wherein opposite side walls of the heat transfer surfaces are perpendicular to the grate and parallel to each other.

11. The fluidized bed boiler according to claim 10, wherein the heat transfer tubes of the heat transfer surface comprise a protective layer having an outer surface forming the side walls of the heat transfer surface.

12. The fluidized bed boiler according to claim 9, wherein the heat transfer tubes of the heat transfer surface are connected to the circulation of the heat transfer medium of the boiler.

13. The fluidized bed boiler according to claim 9, wherein the number of heat transfer tubes placed on top of each other in the heat transfer surface is at least 3.

14. The fluidized bed boiler according to claim 13, wherein the number of heat transfer tubes is 4 to 10.

15. The fluidized bed boiler according to claim 9, wherein the lowermost heat transfer tube of the heat transfer surface is connected by a vertical plate to an upper wall of the elongated element of the grate.

16. A fluidized bed boiler comprising a circulation of heat transfer medium and a furnace, said furnace comprising:

an inner volume, a lower part comprising a grate comprising a plurality of elongated elements spaced at intervals next to each other and leaving openings in areas between the elements, wherein the elongated elements are arranged in a profile having substantially the same shape over a length of the elongated elements in a longitudinal direction of the elongated elements, said openings extending parallel to the elongated elements and being configured to discharge coarse material from the bed through the openings into a discharge unit underneath the grate, and at least one heat transfer surface extending through the inner volume of the furnace;

said heat transfer surface comprising elongated heat transfer tubes on top of each other and being supported from underneath, over a sufficient portion of its length to provide support to the heat transfer tubes, on the grate in a section extending through the inner volume of the furnace, wherein the heat transfer surface is arranged on top of one of the elongated elements of the grate in parallel with the longitudinal direction of the one elongated element of the grate and supported from underneath, over a sufficient portion of its length to provide support to the elongated heat transfer tubes, on the one elongated element of the grate, said elongated heat transfer tubes being arranged on top of each other and extending parallel to the longitudinal direction of the one elongated element.

17. The fluidized bed boiler according to claim 16, wherein two or more heat transfer surfaces are placed on top of the elongated elements of the grate and supported from underneath, over a sufficient portion of their lengths to provide support to the elongated heat transfer tubes, on the elongated elements, said elongated heat transfer tubes being arranged on top of each other and extending parallel to the longitudinal direction of the elongated elements.

18. The fluidized bed boiler according to claim 16, wherein the elongated elements comprise hollow box beams and the means for supplying fluidizing air comprises nozzles connected to hollow insides of the elements.

* * * * *